United States Patent [19]

Fields

[11] Patent Number: 4,555,116

[45] Date of Patent: Nov. 26, 1985

[54] GO GAME EMPLOYING HEXAGONALLY SHAPED SPACES

[76] Inventor: F. Herbert Fields, 1691 Annie St., Colma, Calif. 94015

[21] Appl. No.: 387,091

[22] Filed: Jun. 10, 1982

[51] Int. Cl.[4] ..... A63F 3/00

[52] U.S. Cl. ..... 273/236; 273/282

[58] Field of Search ..... 273/242, 236, 260, 261, 273/262, 258, 290, 275, 271, 248; D21/33, 34, 36, 24

[56] References Cited

U.S. PATENT DOCUMENTS

| | | | |
|---|---|---|---|
| 1,056,526 | 3/1913 | Fortnam | 273/261 |
| 1,165,688 | 12/1915 | Maris | 273/262 |
| 3,724,856 | 4/1973 | Welch | 273/261 |
| 3,768,811 | 10/1973 | Goldfarb et al. | 273/261 |
| 3,778,065 | 12/1973 | Hale | 273/261 |
| 3,917,272 | 11/1975 | Aldeg | 273/260 |
| 4,120,503 | 10/1978 | Macrory et al. | 273/248 |
| 4,157,184 | 6/1979 | Recard | 273/290 |

FOREIGN PATENT DOCUMENTS

| | | | |
|---|---|---|---|
| 929354 | 12/1947 | France | 273/262 |
| 2282284 | 3/1976 | France | 273/260 |

OTHER PUBLICATIONS

Go, *Games of the World,* Rand McNally Company, 1975, pp. 42–49.

"A Handbook of Game Design", How to Design a Board Game, pp. 47–61, copyright 1982, Ellington et al.

"Go" Games and Puzzles, Magazine, Jun. 1974, No. 25.

*Primary Examiner*—Richard C. Pinkham

*Assistant Examiner*—Matthew L. Schneider

*Attorney, Agent, or Firm*—Townsend & Townsend

[57] ABSTRACT

A game board for use in placing a modified version of the ancient board game GO. The board contains a rectangular arrangement of equi-dimensional, contiguous hexagons. Nine predetermined points are marked on the board in the form of one point located in the center area of the center hexagon and eight points, symmetrically located around the one central point. Two differently colored sets of stones are also provided. A different variation to the game includes two rows of colored spaces at each end of the board and apertures at the center of each hexagon and at the corner of each hexagon. The apertures serve to receive pegs which are placed therein.

14 Claims, 8 Drawing Figures

GO GAME EMPLOYING HEXAGONALLY SHAPED SPACES

BACKGROUND OF THE INVENTION

The present invention relates to a game apparatus and more particularly to the board-type game commonly referred to as "GO".

GO is a board game that originated in China, spread to the shores of Japan sometime in the eighth century, and has gradually gained in such popularity so that today enthusiasts can be found, not only in Japan, but also in the United States and Europe.

Traditional GO uses a game board upon the playing surface of which are 19 vertical lines that are intersected by 19 horizontal lines, resulting in 361 intersections. These intersections are the locations for play-placement of player pieces, called "stones." Traditionally, there are the same number of stones as there are intersections: 361, 180 of the stones which are white and 181 are black. Briefly, the game is played by two contestants, one using the black stones and the other using the white stones. Play alternates between each player, with one stone being played at a time. A stone must be played each turn, no "passes" or skipping of turns is allowed. The object of the game is to place stones so as to surround more intersections (territory) than the player's opponent. The stones are limited to being played on the intersections of the lines inscribed on the playing surface (or on the spaces between the lines—but usually not both). For some, the profundity of the intellectual pursuit in learning the game can be a life-long endeavor; for others, on the other hand, mastering the initial concepts of the game can lead to boredom or disenchantment by the somewhat regimented play and limitations imposed, in part, by the constraints of game play. Unfortunately, no satisfactory alternative games of varietal form have been heretofore proposed. Those which have been suggested generally are of the lower intellectual challenge than the traditional GO game.

SUMMARY OF THE INVENTION

The present invention provides a novel and unique game board and apparatus for playing GO according to traditional rules, yet because of the game board design provides a much wider latitude game play than heretofore possible with the traditional GO game board. According to the present invention a game board is provided having a playing surface upon which is inscribed a plurality of rows of contiguous, equi-dimensional hexagons, together with an appropriate number of playing pieces (i.e. stones). The game is played according to the traditional rules of GO with the following modifications: pieces may be played at any hexagon corner or at the center of any hexagon.

The rows of hexagons inscribed on the playing surface are preferably arranged in a first plurality of horizontal rows, each containing a number of hexagons, interlaced with a second plurality of horizontal rows, each containing a number of hexagons less than that of the first plurality of rows. In the preferred embodiment of the invention, there are 163 contiguous, equi-dimensional hexagons inscribed on the playing surface of the game board, and arranged in 7 horizontal rows (each containing 13 of the hexagons) interlaced with 6 horizontal rows (each containing 12 of the hexagons) in a substantially rectangular formation.

An alternate embodiment of the invention provides a game board surface for playing traditional GO games or for playing a modified GO game, the latter being disclosed below. The playing surface of the game board of the alternate embodiment has the plurality of hexagons arranged in a substantially rectangular configuration so that a minimum of P stone placements (i.e., plays) is needed to form a line of connecting stones from any point of play at one vertical edge to a point of play at the opposing vertical edge; and a minimum of P+1 plays vertically from any point of play at one horizontal edge to a point of play at the opposing horizontal edge.

A number of advantages are obtained from the board game apparatus of the present invention. First, the invention provides an intellectually challenging board-type game that offers much more complex game play when using the traditional game play rules of GO. In addition, the traditional GO game is improved. Further still, greater flexibility of movement within the game play is provided.

These advantages are realized primarily by the following aspects of the invention: In contrast to GO play on the traditional board, where only two degrees of freedom of play are allowed (i.e., along a vertical or horizontal line from any particular intersection) the invention provides three degrees of freedom from two separate locations: from a corner of any hexagon or from a center of any hexagon.

These and other objects and features of the present invention will become readily apparent from the following detailed description, taken with reference to the figures of the accompanying drawings.

DETAILED DESCRIPTION OF THE INVENTION

Figure 1:
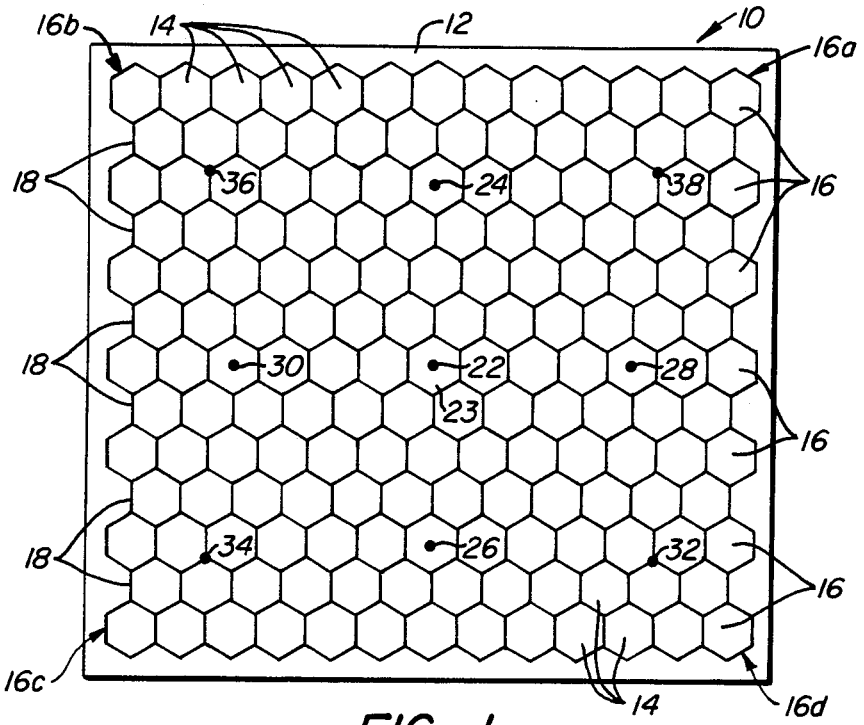
FIG. 1 is a top plan view of a game board embodying the present invention, illustrating the playing surface thereof.

Referring now to FIG. 1 there is illustrated a game board, generally designated with the reference numeral 10, constructed in accordance with the teachings of the present invention. The game board 10 is shown as including a playing surface 12 upon which is inscribed indicia forming a plurality of contiguous, equidimensional, hexagons 14 arranged in interlaced horizontal rows 16 and 18. In the preferred embodiment, illustrated in FIG. 1, there are an odd number (seven) of rows 16, with each row 16 containing an odd number (13) of hexagons, and an even number (six) of interlaced rows 18 with each row 18 containing an even number (12) of hexagons.

The playing surface 12 further includes nine black star points 22–38 ("hoshi" points in traditional GO). A first hoshi point 22 is located in the center of a central hexagon 23, and the remaining eight star points 24–38 are arranged symmetrically about the central hexagon 23 in the pattern as illustrated in FIG. 1: Hoshi points 24, 26, 28 and 30 are equally spaced from the hoshi point 22 vertically above, below, to the right, and to the left, respectively, as seen in FIG. 1; and the hoshi points 32, 34, 36 and 38 are also equally spaced diagonally from the central hoshi point 22, and located on hexagon corners as illustrated.

Figure 2:
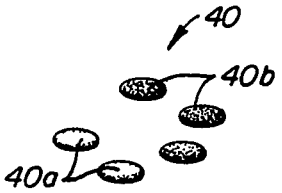
FIG. 2 is an illustration of the game pieces used in playing the game board of the present invention.

FIG. 2 illustrates a few of the game pieces or "stones" 40 used with the present invention. The number of game pieces in traditional GO (i.e., utilizing a game board having vertical and horizontal intersecting lines) depend on the number of playing positions (i.e., line intersections). Using 19 vertical and 19 horizontal intersecting lines will create 361 intersections and 180 white stones, 181 black stones. In the present invention, placement may be on any hexagon corner or at the center space of the hexagon. Accordingly, if tradition is to be adhered to, the present invention will be accompanied by game pieces that number in accordance with the number of play disposition points on the playing surface 12, i.e., 541 stones divided into 270 white stones **40*a* (FIG. 2) and 271 black stones 40*b***.

Figure 3A:
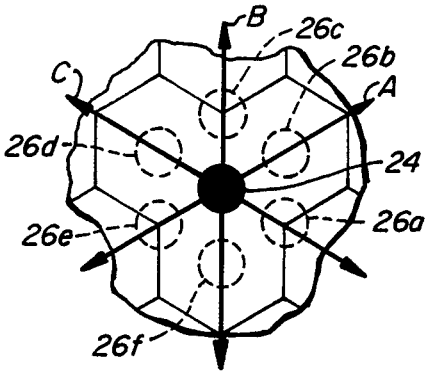
FIGS. 3A and 3B are illustrations of the degrees of freedom of play realized with the game board of FIG. 1.
Figure 3B:
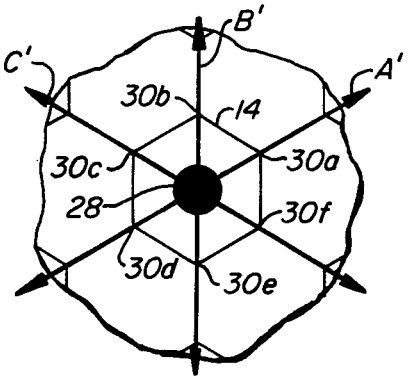

As hereinabove indicated, traditional GO play involves placement of the game pieces in a contiguous manner to form surrounded intersection (territories) on the playing surface. A second stone may be played adjacent a first stone with only two degrees of freedom (horizontally or vertically) in traditional GO. The present invention, however, as illustrated in FIGS. 3A and 3B, provides three degrees of freedom of play from one played stone. Thus, as illustrated in FIG. 3A, with a stone 24 played at a hexagon corner, a second stone may be placed by the same player at any one of six locations (illustrated in phantom) adjacent the played stone 24: at hexagon corners **26*a*, 26*c*, or 26*e* or the hexagon center spaces located at 26*b*, 26*d*, or 26*f*. The three degrees of freedom from the hexagon corner at which stone 24** is played are illustrated by the double arrows A, B, and C.

The three degrees of freedom for adjacent play from a stone played at the center of one of the hexagons 14 is illustrated in FIG. 3B by the double arrows A', B', and C'. Here, a stone 28 played at the center of one of the hexagons 14; a second stone may be played adjacent thereto at any one of the six corners **30*a*–30*f***, along any one of the three paths of directions indicated by the double arrows A', B' and C'.

Figure 4:
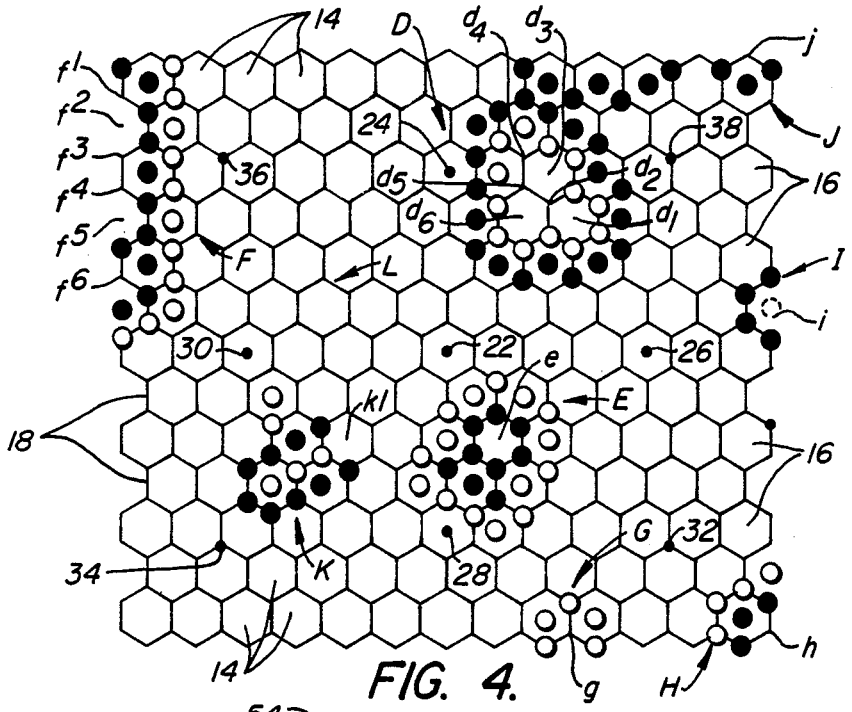
FIG. 4 is a diagrammatic illustration showing game play developments capable when using the invention to play traditional GO.

As mentioned, the game board 10 of the present invention is used to play the ancient game of GO according to the traditional rules. Diagrammatic illustrations of game play development, using the present invention, are illustrated in FIG. 4. The basic object of a game of GO is placement of a number of player pieces or stones in juxtaposed relation to surround vacant areas on the board (called "Ji" or territories). Two players play their respective stones in alternate fashion to form one or more configurations of connecting or linking stones. This connection of stones is referred to as "Tsunagi," and illustrated by the black stones in the development identified as D or the white stones (surrounding a number of black stones) illustrated at E (FIG. 4). A player may never place more than one stone on the board at a time, and also cannot "pass" or refuse to make a play when it is his turn to do so. Note, in FIG. 4, stones, whether black or white, are played at hexagon corners and hexagon centers.

The concept of an eye, called "Me" in GO, is illustrated by the player stone developments at D, E, F, G, H, I and J. The developments at G, H, I, and J illustrate single Mes (called "Ichigan"), the actual locations of the Mes being at the points g, h, i and j, respectively. Note in particular the development at I, which illustrates use of the edge of the game board of the invention to form a Me.

The number of Mes that may be contained within a territory designated by a surrounding number of stones is unlimited. Thus, for example, in the development at D, the white stones form within the Ji (territory) encircled, the five eyes d1–d5. Similarly, the black stone in the development at F form (at the edge of the game board) the six eyes f1–f6.

FIG. 4 also illustrates the concept of in check ("Atari") and capture ("Tori") when GO is played using the present invention. For example, at the development K three white stones are surrounded on three sides by nine black stones. If it were white's play, a white stone could be played at k1, the only adjacent point of play for connecting further white stones to the line of three white stones. This called a "Katsuro," or the "path to survival." However, a move by black placing a stone at k1 will entrap the white stones and lead to their capture or Tori. Accordingly, development at K is described as Atari.

The development at H illustrates the concept of "Shini" or dead in which a group of black stones is surrounded by white stones and having but a single Me at h. The surrounded black stones are considered to be a dead group of stones for the reasons that they are subject to immediate capture by black if a black stone is played at h. This concept is also illustrated by the development at E, where placement of a white stone at C will result in capture of those black stones surrounded by linking white stones. Conversely, the development at D and F illustrate the concept of "Iki" or alive in which a group of stones is completely surrounded by an opponent's stones, yet contains two or more Mes (d1–d5 in the development at D; f1–f6 in the development at F).

Figure 5:
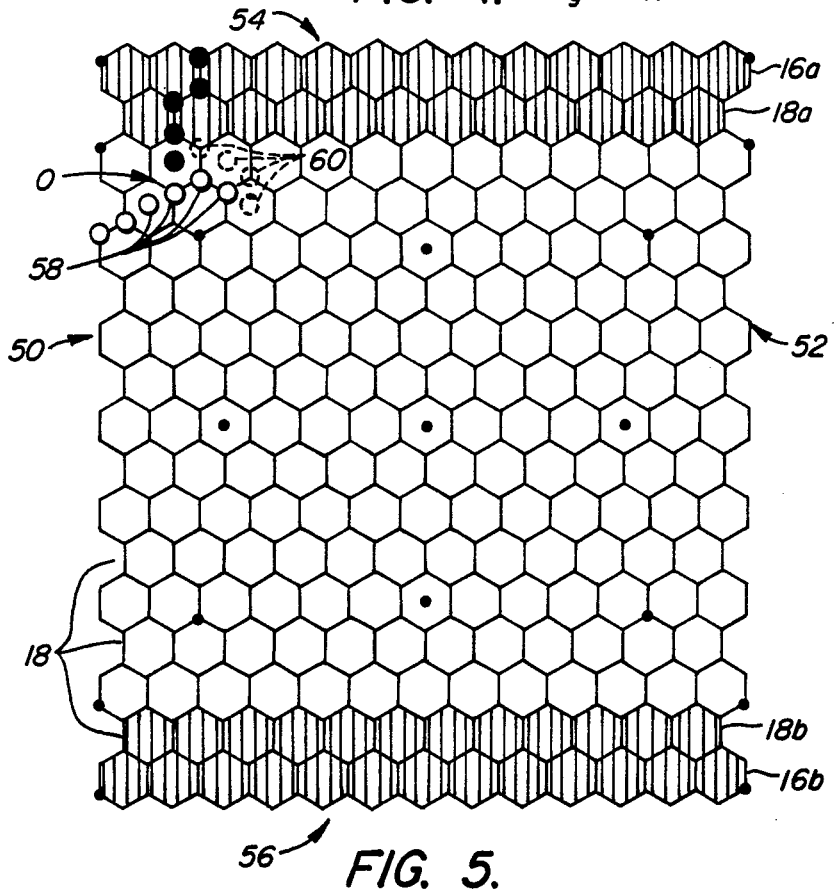
FIG. 5 illustrates an alternate embodiment of the game board illustrated in FIG. 1 for use with a modified version of GO.

Illustrated in FIG. 5 is an alternate embodiment of the present invention in which the number of hexagons 14 is increased four additional rows of hexagons, two rows **16*a* and 18*a* at the top (containing 13 and 12 hexagons, respectively) and two rows 16*b* and 18*b*** at the bottom (containing 13 and 12 hexagons, respectively). This alternate embodiment of the present invention provides for a modified, shortened version of GO in which the object is to form a connecting link of (single-color) stones from any point of play on one edge of the hexagonal arrangement to any point of play on an opposing edge.

As with the traditional GO, moves are alternated between the player of the black stones and the player of the white stones throughout the game, with the points of play at which a stone may be placed being any hexagon point or an open center of a hexagon. One player plays horizontally (i.e., plays to form a connecting link of stones from a left edge 50 to a right edge 52 of the hexagonal arrangement). The second player plays vertically (i.e., from the top edge 54 and bottom edge 56) in an attempt to form a connecting link of stones. Two adjacent stones form a blockade to the movement of an opponent, such as illustrated at O. The connecting white stones 58 form a barrier that the player of the black stones cannot traverse, black must attempt to extend the link of black stones around the white stones 58, such as the possible illustrated in phantom at 60. As many lines of connecting stones as necessary can be started at any point on the board.

In order to distinguish those hexagons forming the play area for traditional GO from that of the alternate embodiment, the four added rows 16*a*, 16*b*, 18*a*, and 18*b* are provided with initia (i.e., coloring, with the remaining hexagons of the board left uncolored or provided a contrasting) color.

Figure 6:
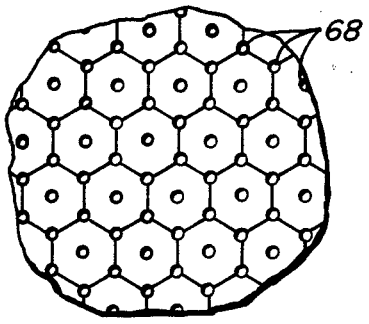
FIG. 6 is a further embodiment of the present invention illustrating the use of apertures to delineate the points of play designated by the hexagons of the present invention.
Figure 7:
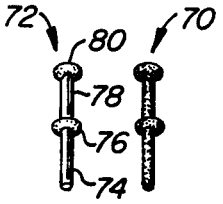
FIG. 7 illustrates player pieces adapted to be used in the embodiment of the invention shown in FIG. 6.

Referring now to FIGS. 6 and 7, a further embodiment of the invention, for use for example during travel is illustrated. As shown in FIG. 6, each of the points of play delineated on the game board 10 (FIG. 1) by the corners or centers of the hexagon 14 that are unscribed on the playing surface 12 are provided with apertures 68. The game pieces for use with the game board having the apertures 68 are illustrated in FIG. 7, and shown as black and white pegs 70 and 72, respectively. All pegs are identically constructed, and, as illustrated by the white peg 72, include a shank 74 configured to removably fit into the apertures 68 formed in the game board 10, a collar 76, separating the shank 74 from a neck portion 78. If desired, for aesthetic reasons, a bulbous head section 80 may be provided.

The embodiment of the invention illustrated in FIGS. 5 and 6 allow persons to play traditional GO game, or modifications thereof, including the modification described with respect to FIG. 4, while traveling in moving vehicles. Game play is effected by merely placing the shank 74 of a black or white player piece 70, 72 into the desired (unoccupied) aperture 68 of the game board.

In summary, the disclosed invention provides a game board having a playing surface upon which is inscribed a substantially rectangular formation of equi-dimensional hexagons for playing the ancient game of GO according to traditional rules. Game play allows placement of stones at both hexagon corners and centers. Although the invention has been described above in considerable detail with reference to several possible embodiments, it should be appreciated that many modifications and variations exist and might be used to adapt this invention to playing GO. For example, referring to FIG. 1, the corner hexagons (designated as 17) can be eliminated, retaining still the substantially rectangular configuration of hexagons. Accordingly, it should be appreciated that the scope of the invention is to be determined solely with reference to the following appended claims.

I claim:

1. GO game apparatus, comprising:

a game board having a playing surface and first indicia thereon forming a number of equi-dimensional hexagons arranged in a contiguous, substantially rectangular configuration of $2N-1$ horizontal rows, there being N horizontal rows of hexagons, each containing X of the number of hexagons, interlaced with $N-1$ horizontal rows, each containing $X-1$ of the number of hexagons, where N and X are integers, the hexagons thereby defining an area of play;

second indicia denoting nine predetermined points of play on the playing surface, a first one of the denoted points of play being located generally in the center of a substantially central hexagon, the remaining ones of the denoted points being located within the area of play and symmetrically disposed about the first one of denoted points; and two sets of game pieces for disposition on the playing surface, the game pieces being substantially identical to one another in size and shape and having third indicia for distinguishing the game pieces of the first set from the game pieces of the second set.

2. The game apparatus of claim 1, wherein $N=7$ and $X=13$.

3. The game apparatus of claim 1, wherein $N=9$ and $X=13$.

4. The game apparatus of claim 3, including fourth indicia for distinguishing a top two and a bottom two horizontal rows from the remaining horizontal rows.

5. Game apparatus, comprising:

a game board having a planar playing surface, the playing surface including first indicia delineating a plurality of equi-dimensional hexagons arranged in a generally rectangular configuration and symmetrically about a center one of the plurality of hexagons to define an area of play, second indicia denoting nine substantially identical, predetermined playing positions within the area of play, a one of the predetermined playing positions being located on the playing surface generally in the center of said center hexagon and the remaining eight predetermined playing positions being located on the playing surface symmetrically about said center hexagon; and two sets of game pieces for disposition on the playing surface, the game pieces being substantially identical to one another in size and shape, the game pieces of one of the two sets having a third indicia indicative of membership in said one of two sets.

6. The game apparatus of claim 5, wherein said pluality of hexagons are arranged in N rows, each containing X hexagons, interlaced with M rows each containing Y hexagons, where N, M, and X are integers.

7. The game apparatus of claim 6, wherein N and X are odd intergers, and M is an even integer.

8. The game apparatus of claim 6, wherein $M=N-1$ and $Y=X-1$.

9. The game apparatus of claim 8, wherein $N=7$, $M=6$, $X=13$ and $Y=12$.

10. The game apparatus of claim 5, the playing surface having a plurality of apertures, said plurality of apertures forming the first indicia.

11. The game apparatus of claim 5, wherein the first indicia forms 163 hexagons on said playing surface, said hexagons being arranged in seven horizontal rows each containing 13 hexagons interlaced with six horizontal rows each containing 12 hexagons.

12. The game apparatus of claim 5, wherein the first indicia forms 213 hexagons on said playing surface, said hexagons being arranged in 9 horizontal rows each containing 13 hexagons interlaced with 8 horizontal rows each containing 12 hexagons; and including fourth indicia distinguishing a top two horizontal rows of hexagons and a bottom two horizontal rows of hexagons as being a playing area different from that of the remaining ones of the plurality of hexagons.

13. A game board for playing GO, the game board comprising:

a playing surface having an area of play defined by first indicia forming a plurality of $2N-1$ horizontal rows of equi-dimensional hexagons arranged in N horizontal rows, each containing X of the plurality of hexagons, interlaced with N−1 rows, each containing X−1 hexagons, where N and X are integers, the N and N−1 horizontal rows being contiguous and forming a substantially rectangular configuration, the playing surface including second indicia defining nine substantially identical points of play within the area of play, a one of the points of play being located substantially in the center of the area of play, the remaining points of play being symmetrically disposed about the one of the points of play; and means for supporting the playing surface.

14. Game apparatus for playing GO, comprising:

a game board having a playing surface and first indicia thereon defining an area of play formed from a number of equi-dimensional hexagons arranged in a substantially rectangular configuration of horizontal rows;

second indicia denoting nine substantially identical predetermined points of play on the playing surface and within the defined area of play, a first one of the denoted points of play being located generally in the center of a substantially central hexagon; and two sets of game pieces for disposition on the playing surface, the game pieces being substantially identical to one another in size and shape and having third indicia for distinguishing the game pieces of the first set from the game pieces of the second set.

* * * * *